US006761653B1

(12) United States Patent
Higginbotham et al.

(10) Patent No.: US 6,761,653 B1
(45) Date of Patent: Jul. 13, 2004

(54) COMPOSITE WRAP BAT WITH ALTERNATIVE DESIGNS

(75) Inventors: Brian E. Higginbotham, Tullahoma, TN (US); Terry Sutherland, Ottawa (CA)

(73) Assignee: Worth, LLC, Tullahoma, TN (US)

( * ) Notice: Subject to any disclaimer, the term of this patent is extended or adjusted under 35 U.S.C. 154(b) by 0 days.

(21) Appl. No.: 10/144,251

(22) Filed: May 13, 2002

Related U.S. Application Data

(63) Continuation-in-part of application No. 09/571,018, filed on May 15, 2000, now Pat. No. 6,461,260.

(60) Provisional application No. 60/290,311, filed on May 11, 2001.

(51) Int. Cl.[7] ..... A63B 59/06

(52) U.S. Cl. ..... 473/566; 473/567

(58) Field of Search ..... 473/566, 567

(56) References Cited

U.S. PATENT DOCUMENTS

| | | | |
|---|---|---|---|
| 46,910 | A | 11/1865 | Sutherland |
| 398,680 | A | 9/1889 | Kennedy et al. |
| 1,121,189 | A | 12/1914 | Lincoln |
| 2,944,820 | A | 7/1960 | Paullus |
| 3,129,003 | A | 4/1964 | Mueller et al. |
| 3,184,236 | A | 5/1965 | Zens |
| 3,433,481 | A | 3/1969 | Tanguay |
| 3,598,410 | A | 8/1971 | Costopoulos |
| 3,972,528 | A | 8/1976 | McCracken et al. |
| 3,997,161 | A | 12/1976 | Lemke, Jr. |
| 4,014,542 | A | 3/1977 | Tanikawa |
| 4,023,801 | A | 5/1977 | Van Auken |
| 4,025,377 | A | 5/1977 | Tanikawa |
| 4,032,143 | A | 6/1977 | Mueller et al. |
| 4,082,277 | A | 4/1978 | Van Auken et al. |
| 4,084,819 | A | 4/1978 | Van Auken |
| 4,086,115 | A | 4/1978 | Sweet, Jr. et al. |
| 4,092,025 | A | 5/1978 | Yanagioka |
| 4,113,248 | A | 9/1978 | Yanagioka |
| 4,131,701 | A | 12/1978 | Van Auken |
| 4,135,035 | A | 1/1979 | Branen et al. |
| 4,173,670 | A | 11/1979 | Van Auken |
| 4,241,115 | A | 12/1980 | Temin |
| 4,324,400 | A | 4/1982 | Tse |
| 4,351,786 | A | 9/1982 | Mueller |
| 4,361,325 | A | 11/1982 | Jansen |
| 4,373,718 | A | 2/1983 | Schmidt |
| 4,399,992 | A | 8/1983 | Molitor |
| 4,413,822 | A | 11/1983 | Fernandez et al. |
| 4,436,305 | A | 3/1984 | Fernandez |
| 4,498,672 | A | 2/1985 | Bulla |
| 4,505,479 | A | 3/1985 | Souders |
| 4,537,398 | A | 8/1985 | Salminen |
| 4,541,629 | A | 9/1985 | Witkowski |
| 4,546,976 | A | 10/1985 | Jones |
| 4,569,521 | A | 2/1986 | Mueller |
| 4,572,508 | A | 2/1986 | You |
| 4,579,343 | A | 4/1986 | Mortvedt |
| 4,614,341 | A | 9/1986 | Fernandez |

(List continued on next page.)

*Primary Examiner*—Mark S. Graham
(74) *Attorney, Agent, or Firm*—Waddey & Patterson, P.C.; Phillip E. Walker; Edward D. Lanquist, Jr.

(57) ABSTRACT

A metal baseball or softball bat may be improved both for durability and performance by selectively placing a layer of fiber reinforced composite material around portions of the bat. In one embodiment the barrel portion of the bat may have a fiber reinforced composite layer directly laid up upon the metal bat frame. In a second embodiment, the barrel portion of the bat may include an outer metal sleeve placed about the metal bat frame, with an exterior fiber reinforced composite shell being formed on the outer metal sleeve. In a third embodiment, an intermediate portion of the bat adjacent a zone of maximum bending stress may be reinforced by the placement of a fiber reinforced composite outer layer on the metal frame of the bat adjacent the area of maximum bending stress.

10 Claims, 13 Drawing Sheets

U.S. PATENT DOCUMENTS 4,684,131 A 8/1987 Mortvedt
4,705,273 A 11/1987 Ament et al.
4,720,104 A 1/1988 DiSieno
4,732,383 A 3/1988 Ferrari et al.
4,746,117 A 5/1988 Noble et al.
4,763,900 A 8/1988 Carr
4,834,370 A 5/1989 Noble et al.
4,848,745 A 7/1989 Bohannan et al.
4,923,541 A 5/1990 Burger
4,928,965 A 5/1990 Yamaguchi et al.
4,981,737 A 1/1991 Rico
5,077,106 A 12/1991 Dursch et al.
5,083,780 A 1/1992 Walton et al.
5,088,735 A 2/1992 Shigetoh
5,093,162 A 3/1992 Fenton et al.
5,104,123 A 4/1992 Okitsu et al.
5,114,144 A 5/1992 Baum
5,131,651 A 7/1992 You
5,165,686 A 11/1992 Morgan
5,180,163 A 1/1993 Lanctot et al.
5,217,221 A 6/1993 Baum
5,217,223 A 6/1993 Feeney
5,219,163 A 6/1993 Watson
5,301,940 A 4/1994 Seki et al.
5,364,095 A 11/1994 Easton et al.
5,380,003 A 1/1995 Lanctot
5,395,108 A 3/1995 Souders et al.
5,409,214 A 4/1995 Cook
5,458,330 A 10/1995 Baum
5,460,369 A 10/1995 Baum
5,511,777 A 4/1996 McNeely
5,533,723 A 7/1996 Baum
5,593,158 A 1/1997 Filice et al.
5,620,179 A 4/1997 MacKay, Jr.
5,624,114 A 4/1997 Kelsey
5,624,115 A 4/1997 Baum
5,676,609 A 10/1997 Mollebaek
5,676,610 A 10/1997 Bhatt et al.
5,722,908 A 3/1998 Feeney et al.
5,759,113 A 6/1998 Lai et al.
5,800,293 A 9/1998 MacKay, Jr.
5,820,438 A 10/1998 Horton, III
5,833,561 A 11/1998 Kennedy et al.
6,022,282 A 2/2000 Kennedy et al.
6,042,493 A 3/2000 Chauvin et al.
6,053,828 A 4/2000 Pitsenberger
6,159,116 A 12/2000 Pitsenberger

COMPOSITE WRAP BAT WITH ALTERNATIVE DESIGNS

APPLICATION FOR PROVISIONAL UNITED STATES LETTERS PATENT

Be it known that I, Brian E. Higginbotham, a citizen of the United States, residing at 406 Westside Heights Dr, Tullahoma, Tenn. 37388, have invented a new and useful "Composite Wrap Bat With Alternative Designs".

This application is based upon U.S. patent application Ser. No. 60/290,311 filed May 11, 2001 and is a continuation in part U.S. patent application Ser. No. 09/571,018 filed May 15, 2000 now U.S. Pat. No. 6,461,260.

BACKGROUND OF THE INVENTION

1. Field of the Invention

The present invention relates generally to the construction of baseball and softball bats, and more particularly, but not by way of limitation, to lighter and stronger bat constructions provided by the use of an external composite wrap on a portion of a metal bat frame.

2. Description of the Prior Art

One recent advancement in the design of high performance baseball and softball bats includes the use of an external metal shell formed about, an internal tubular bat frame as disclosed in U.S. Pat. No. 6,053,828, by Pitsenberger for "Softball Bat With Exterior Shell", assigned to the assignee of the present invention, the details of which are incorporated herein by reference.

The prior art has also included a number of other proposals for bat designs including internal and external sleeves, some of which have been constructed from composite materials.

For example, U.S. Pat. No. 5,364,095 assigned to Easton, Inc., discloses a tubular metal bat having an internal fiber composite sleeve.

U.S. Pat. No. 6,022,282 issued to Kennedy et al., discloses a ball bat having an internal metal tube surrounded by an external composite tube along its entire length (see FIG. 3).

U.S. Pat. No. 5,722,908 discloses a composite bat with a metal barrel area.

Upon review of these prior art designs, it will be seen that none of them show or suggest the use of a composite external layer along only a portion of the bat for either the strengthening of the bat at a point of maximum bending moment, or for increasing the external durability of the bat to reduce denting and the like upon impact with a ball.

SUMMARY OF THE INVENTION

The present invention provides several alternative designs for a bat including a metal frame with an exterior fiber reinforced composite shell.

In one embodiment, the bat includes a metal frame having a fiber reinforced composite outer shell formed directly about the barrel portion of the bat. Preferably, the metal frame includes a handle portion, a transition portion and a barrel portion, with the metal frame having an annular step defined therein distally of the handle portion. The fiber reinforced composite outer shell is formed about the metal frame and has a proximal end located adjacent the annular step of the metal frame.

In a second embodiment of the invention, the barrel portion of the bat includes an outer metal shell formed about the barrel portion of the frame, with a fiber reinforced composite outer shell formed about the outer metal shell.

In still a third embodiment of the invention, a fiber reinforced composite outer shell is formed around only an intermediate portion of the metal frame spanning a point of maximum bending stress, so as to provide increased stiffness of the bat at the area of the point of maximum bending stress. The metal frame of the bat extends both proximally and distally from the intermediately located fiber reinforced composite outer shell.

Methods of manufacturing bats utilizing a composite wrapped exterior shell are also disclosed.

Accordingly, it is an object of the present invention to provide improved baseball and softball bats having selected portions of a metal bat frame reinforced by an exterior fiber reinforced composite shell.

Another object of the present invention is the provision of bats having a lighter, yet stronger, construction than conventional bat designs.

Still another object of the present invention is the provision of a bat having a metal bat frame which is selectively reinforced at selected portions thereof by a fiber reinforced composite outer shell.

Still another object of the present invention is the provision of bats having improved durability and resistance to denting.

And another object of the present invention is the provision of bats having improved performance characteristics so that they will hit a ball further.

And another object of the present invention is the provision of improved methods for construction of bats having a metal frame with an exterior composite layer.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

Figure 1:
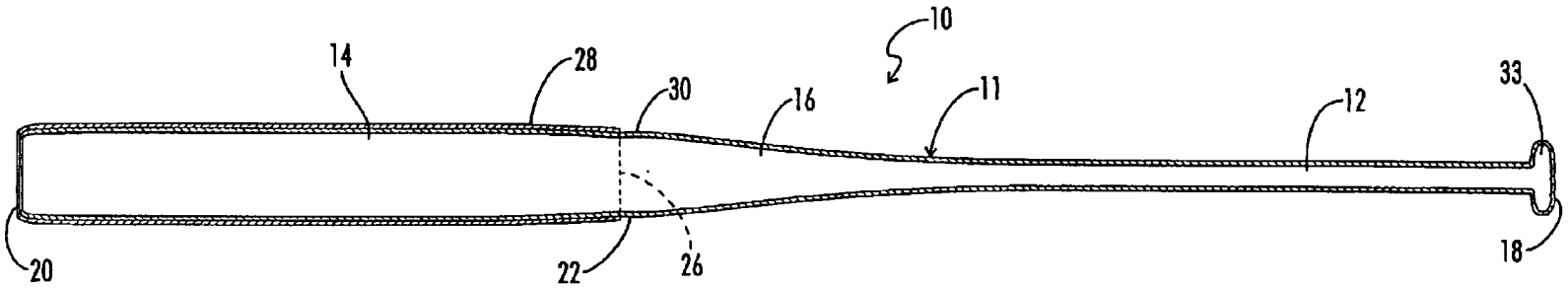
FIG. 1 is a lengthwise sectioned view of a first embodiment of a bat with a metal frame and an exterior composite shell around the barrel area.

Referring now the drawings, and particularly to FIG. 1, a bat is shown and generally designated by the numeral 10. The bat 10 includes a metal frame 11 including a handle portion 12, a barrel portion 14, and a transition portion 16 joining the handle portion 12 and barrel portion 14.

The bat frame 11 can be generally described as having a proximal end 18 and a distal end 20.

As seen in FIG. 1, at about the location of the junction between the transition portion 16 and the barrel portion 14, there is an annular step 22 formed in the bat frame 11. The annular step 22 can be described as being located distally of the handle portion 12.

A fiber reinforced composite outer shell 24 is formed about the metal frame 11. The outer shell 24 has a proximal end 26 located adjacent the annular step 22 of the metal frame 11.

The fiber reinforced composite outer shell 24 terminates distally of the handle portion 12 so that the handle portion 12 is not covered by the outer shell 24.

As seen in FIG. 1, an exterior surface 28 of the composite outer shell 24 and an exterior surface 30 of the metal frame just proximal of the annular step 22 substantially align to define a smooth outer profile of the bat 10 in the area of the annular step 22.

The distal end 20 of the bat 10 is preferably closed by a conventional end plug (not shown).

A knob 33 is attached, typically by welding, to the proximal end 18 of the bat frame 11.

Figure 2:
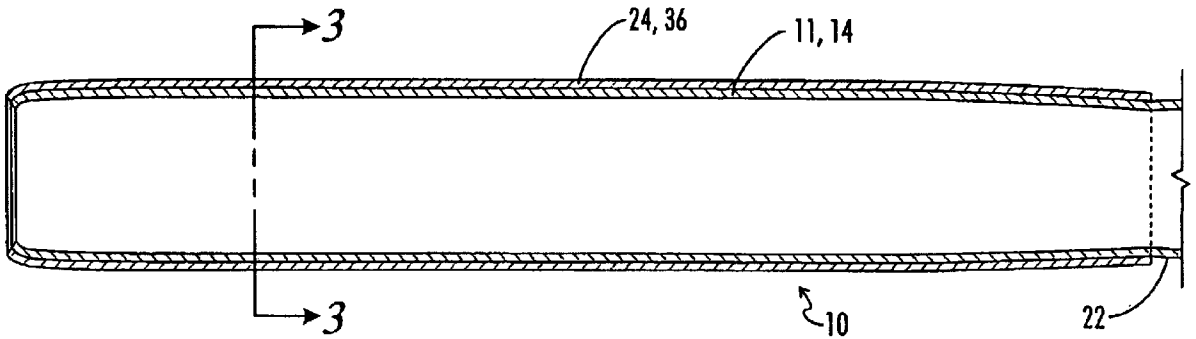
FIG. 2 is an enlarged view of a portion of the barrel of the bat of FIG. 1.

FIG. 2 is an enlarged cross-sectional view of a segment of the barrel portion 14 of the bat 10, and shows the manner of construction of the fiber reinforced composite outer shell 24.

In the embodiments of FIGS. 1 and 2, the fiber reinforced composite outer shell 24 is formed directly on and bonded to the barrel portion 14 of the bat frame 11.

The outer shell 24 is preferably formed of a bidirectional fiber reinforced sock placed about barrel portion 14. The details of construction of the sock 36 are further illustrated and described with reference to FIGS. 8 and 9. After placing the sock 36 around the barrel portion 14, the sock 36 is impregnated with a resin matrix which is then allowed to harden to form a hardened outer shell or outer layer 24 about the metal bat frame 11.

Suitable material for the bidirectional fiber reinforced sock exterior layer 36 includes woven fiberglass or carbon fiber or like materials.

Suitable resin matrix material for impregnating the fiber layers includes two-part epoxy resin with various rubber materials added for greater impact resistance.

In this manner, a bat is provided which can have a much thinner metal barrel portion 14 than would a traditional bat, thus providing a lighter bat, which provides the necessary additional strength via the fiber reinforced composite exterior shell 24.

For example, a satisfactory bat like that illustrated in FIGS. 1 and 2 having the fiber reinforced composite outer layer placed directly upon the barrel portion 14 of the bat frame 11, and wherein the bat frame 11 is constructed of a conventional aluminum material such as 7055 aluminum alloy, the metal barrel portion would have a wall thickness in the range of 0.040 to 0.125 inches, in the fiber reinforced composite outer shell 24 will have a wall thickness in the range of 0.020 to 0.100 inches.

With this construction wherein the barrel portion of the bat is surrounded by a fiber reinforced composite outer shell, the outer shell reduces denting of the barrel portion of the bat when used to strike a ball.

As seen in FIG. 1, the sock 36 of the outer shell 24 is a tubular sock which is open at both its proximal and distal ends.

Figure 9:
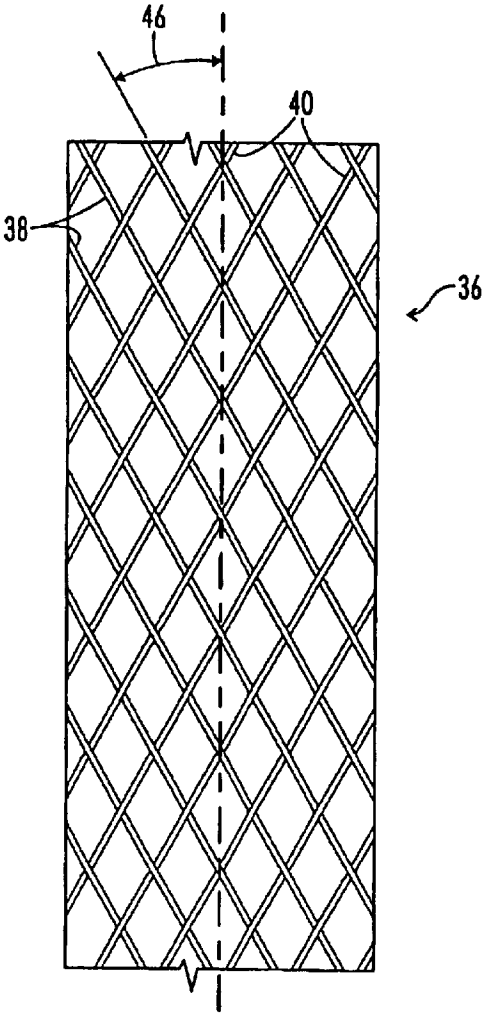
FIG. 9 is a view similar to FIG. 8, showing the sock of FIG. 8 having been stretched in a longitudinal direction so that its fibers now are oriented at an angle of approximately 30° to the longitudinal axis of the sock.
Figure 8:
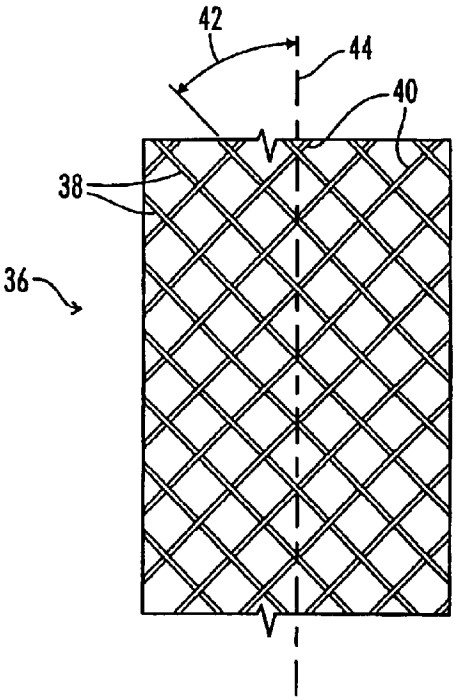
FIG. 8 is a schematic lengthwise illustration of a bidirectional fiber reinforced sock having the fibers laying at an angle of approximately 45° to a longitudinal axis of the sock.

As shown in FIG. 8, the sock 36 is a woven sock which in a relaxed condition has bidirectional fiber orientations running crosswise to each other. As schematically illustrated in FIG. 8, the group of fibers 38 is oriented substantially perpendicular to a second group of fibers 40, each of which is oriented at an angle 42 of approximately 45° to a longitudinal axis 44 of the sock 36. FIG. 8 illustrates the condition of the sock 36 prior to being placed upon the bat 10. As the sock 36 is pulled into place about the bat 10, it stretches parallel to its longitudinal axis 44, so that the stretched sock has a stretched bidirectional fiber orientation at an angle 46 which in the illustrated embodiment is approximately 30°, as shown in FIG. 9.

An alternative version of the fiber reinforced composite outer shell may also include an inner layer (not shown) of unidirectional fiber reinforced tape, such as a carbon fiber tape, which is wrapped around the barrel portion 14 of bat frame 11 prior to placement of the sock 36 about the layer of unidirectional wrapped tape. Any other conventional constructions of fiber reinforced composite materials may be utilized.

Figure 4:
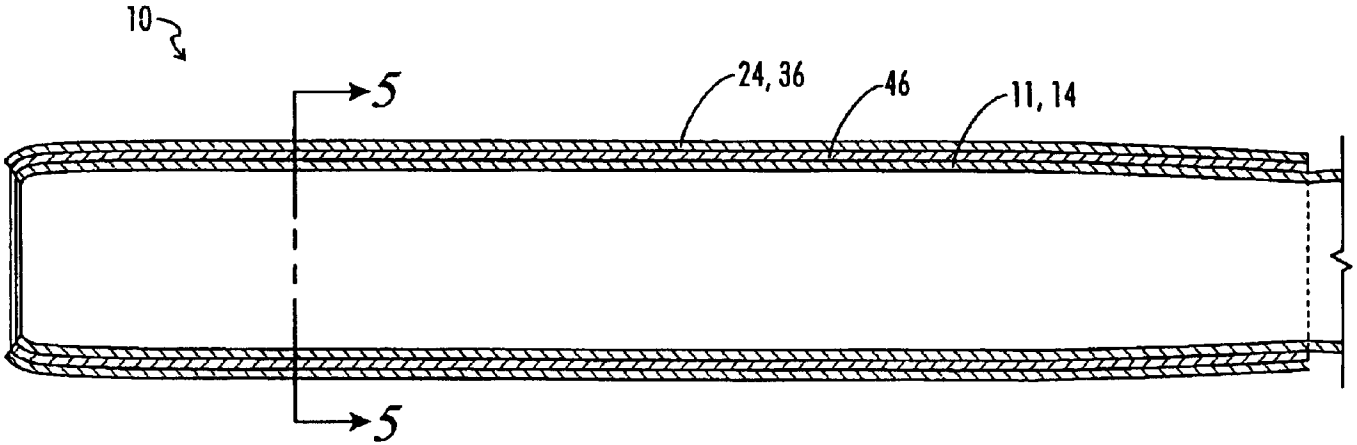
FIG. 4 is a cross-sectional view similar to FIG. 2 of a second embodiment of the invention wherein the metal frame of the bat is surrounded by an outer metal sleeve which is in turn surrounded by a composite shell.
Figure 5:
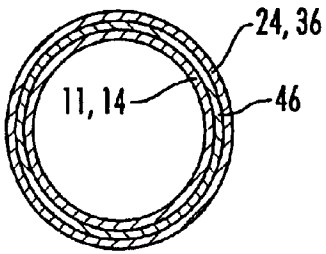
FIG. 5 is a cross-sectional view taken along line 5—5 of FIG. 4.

Turning now to FIGS. 4 and 5, a second embodiment of the invention is illustrated. In this embodiment, the barrel portion 14 of the metal bat frame 11 has received thereabout an outer metal sleeve 46 which is constructed in a manner substantially like that of Pitsenberger U.S. Pat. No. 6,053,828, the details of which are incorporated herein by reference. This external metal sleeve 46 covers the barrel portion 14 of the bat and terminates adjacent the annular step 22 so that it is substantially co-extensive with the outer composite shell 24 seen in FIG. 1. In the embodiment of FIGS. 4 and 5, the outer composite shell 24 is in fact formed on the outer metal shell 46.

Figure 3:
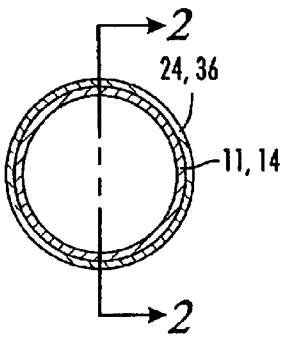
FIG. 3 is a cross-sectional view taken along lines 3—3 of FIG. 2.

Thus, after formation of the outer metal shell 46 about the metal bat frame 11 in a manner like that described in U.S. Pat. No. 6,053,828, the fiber reinforced composite outer shell 24 is formed upon the outer metal shell 46 in a manner like that just described with regard to the embodiment of FIGS. 1–3.

With the embodiment of FIGS. 4 and 5, the outer metal shell 46 may be thinner than the outer shell of the Pitsenberger application, and additional reinforcement is provided by the exterior fiber reinforced composite layer 24.

With the embodiment of FIGS. 4 and 5, the dimensions of the metal bat frame 11, the outer metal shell 46 and fiber reinforced composite outer shell 24, and the dimensions of the annular step 22, are preferably chosen so that the exterior surface of the fiber reinforced composite outer shell 24 aligns with the exterior surface of the transition portion 16 of the bat to form a substantially smooth and continuous exterior bat surface across the annular step 22.

In one preferred example of a bat constructed as shown in FIGS. 4 and 5, the metal barrel portion 14 of bat frame 11 has a wall thickness of approximately 0.047 inches and has an outside diameter of 2.060 inches. The exterior metal shell 46 has a wall thickness of 0.055 inches and has an outside diameter of 2.170 inches. Both the bat frame 11 and the outer metal shell 46 are constructed of 7055 aluminum alloy. This example has a composite outer shell 24 constructed from the woven fiber sock 30 having a wall thickness of 0.030 inches and having an outside diameter of 2.230 inches.

More generally, a bat constructed as shown in FIGS. 4 and 5 can be described as having an aluminum bat frame 11 and an aluminum metal outer shell 46, each of which has a wall thickness in the range of 0.030 to 0.060 inches. The bat has a fiber reinforced composite outer shell 24 having a wall thickness in the range of 0.020 to 0.0100 inches.

Figure 10:
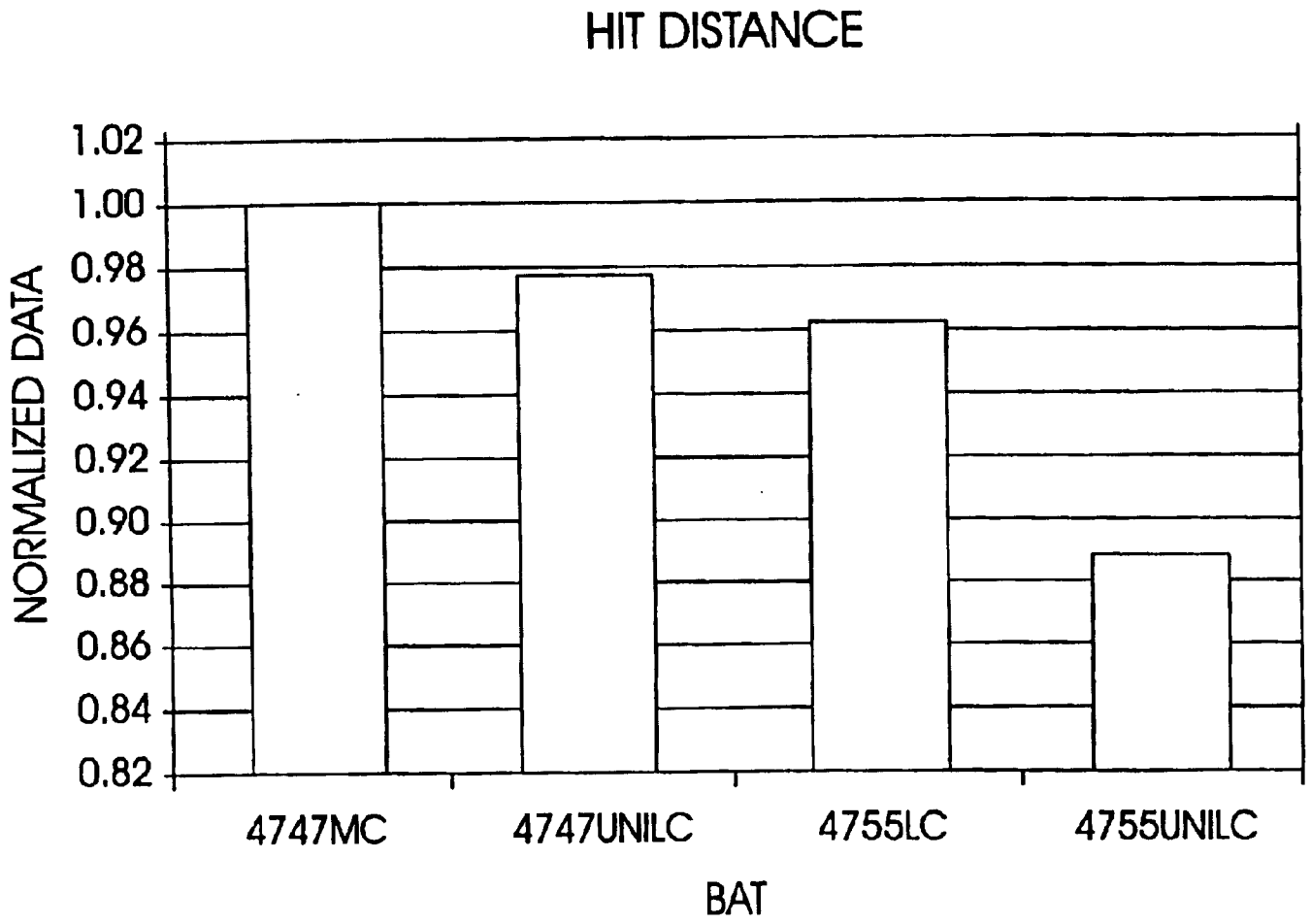
FIG. 10 is a chart showing hit distance versus bat construction for several example bats.

FIG. 10 graphically illustrates the performance of several examples of bats constructed in accordance with FIGS. 4 and 5. The vertical axis represents normalized distance the bat will hit a ball, with the longest distance represented as 1.0. The four examples are labeled to identify the wall thicknesses of the bat frame 14, and metal shell 46, and the type and thickness of composite construction. Example 4747MC had a barrel wall thickness 14 of 0.047 inches, a metal shell 46 wall thickness of 0.047 inches, and a composite layer 24 made up of a medium weight carbon fiber sock 36 resulting in a composite shell 24 having a wall thickness of 0.030 inches. Example 4747UNILC differed in that its composite layer 24 was made up of a first layer of unidirectional carbon fiber tape covered by a light weight carbon fiber sock. Example 4755LC had a barrel wall thickness of 0.047 inches, a metal shell wall thickness of 0.055 inches, and a composite layer made up of a light weight carbon fiber sock. The final example 4755UNIIC added a layer of unidirectional tape to the third example. Thus, the optimum example of the four tested was 4747MC.

Figure 6:
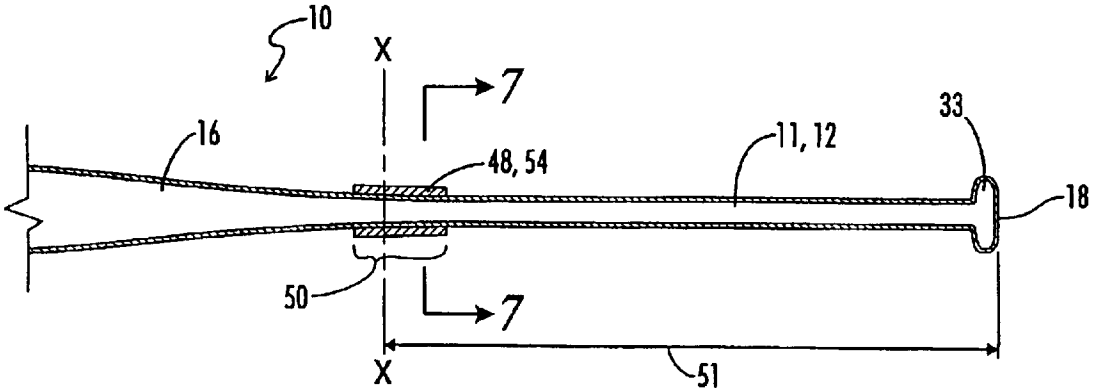
FIG. 6 is a longitudinal section view of yet another embodiment of the invention having an exterior fiber reinforced composite layer formed around an intermediate portion of the bat subjected to a maximum bending stress.
Figure 7:
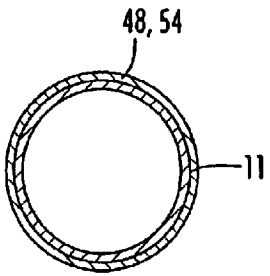
FIG. 7 is a cross-section of the bat of FIG. 6 taken along lines 7—7 of FIG. 6.

FIGS. 6 and 7 illustrate a third embodiment of the invention wherein a fiber reinforced composite outer shell 48 is formed only about an intermediate portion 50 of the metal frame 11.

It will be understood that for any given design of a bat, the bat frame will have a point along its length which is subjected to a maximum bending stress when the bat is used to strike a ball. For example, the bat shown in FIG. 6 may have a point of maximum bending stress along the line x-x. For example, for a typical aluminum bat construction, the point of maximum bending stress x-x would be located a distance 51 from the proximal end 18 of the bat, which distance would typically be approximately 11 inches and would place the point of maximum bending stress x-x in the distal part of the handle portion 12 of the bat frame 11.

The present invention also envisions the selective strengthening of a metal bat by the placement of a fiber reinforced composite outer shell 48 only around an intermediate portion 50 of the bat frame which spans the point x-x of maximum bending stress, so as to provide increased stiffness of the bat in the area of maximum bending stress.

With reference to FIG. 7, the outer shell 48 will preferably be formed of a layer 54 formed of a bidirectional fiber reinforced sock, with a matrix of resin material impregnating the sock 54 to form a hardened outer layer or shell 48.

Again, such a construction can allow a given bat to be made of a thinner wall thickness metal material than would a traditional metal bat. One specific example of such a bat would have an aluminum bat frame 11 having a wall thickness in the area x-x of approximately 0.085 inches, reinforced by a fiber reinforced composite outer layer shell 48 having a wall thickness of 0.030 inches. More generally, such a bat can be described as an aluminum metal bat having a wall thickness at point x-x or in the intermediate portion 50 in the range of 0.050 to 0.100 inches, and having a composite outer shell 48 with a wall thickness in the range of 0.020 to 0.100 inches.

With this construction, the outer shell 48 is formed only about the intermediate portion 50 of the bat frame 11 so that the bat frame 11 extends both distally and proximally out of the outer shell 48. In this construction, the primary purpose of the fiber reinforced composite outer layer 48 is to strengthen the bat in its zone of maximum bending stress.

The selective use of strategically positioned fiber reinforced composite outer layers on a metal bat provide a number of advantages over bats constructed solely of metal. Using composite materials allows the designer more flexibility in the design of the bat. This design flexibility covers virtually all parameters that add value to a bat, including performance, durability and weight. More specifically, composite materials allow the bat to be designed for varying stiffness at desired locations, weight savings for either lighter weight or a variety of weight distributions, and strength increases for durability gains.

Additional alternative embodiments 1–8 for bat designs are also provided as shown in FIGS. 11 through 18.

Figure 11:
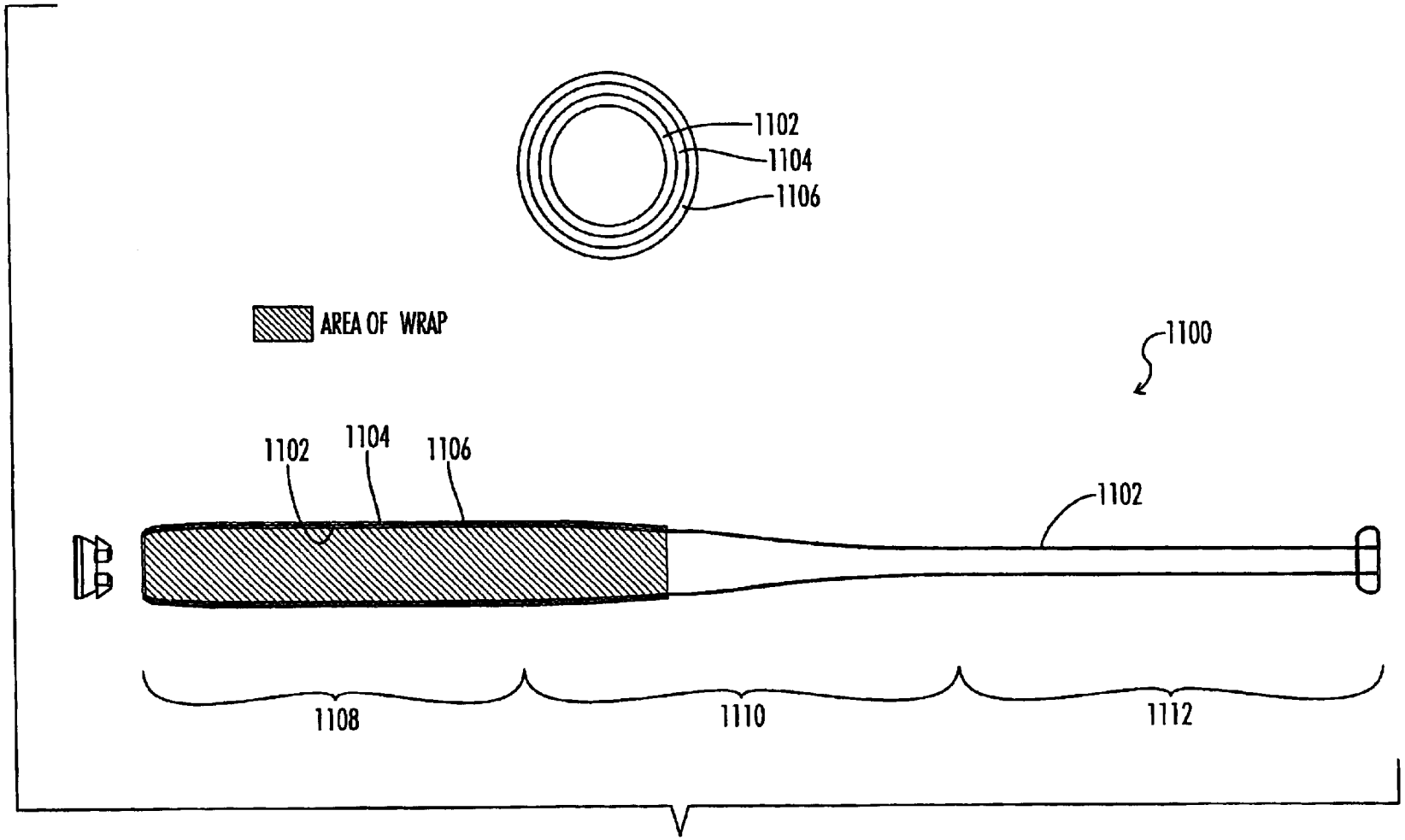
FIGS. 11–18 show alternative designs of the composite bat structure.

Embodiment 1 is shown in FIG. 11. This invention pertains to a bat 1100 with an aluminum frame 1102, aluminum shell 1104, and a composite shell 1106 outside of the aluminum shell 1104. The aluminum shell 1102 and composite shell 1104 are in the barrel 1108 and slightly in the taper section 1110 of the bat 1100. The remaining taper section 1110 and handle section 1112 would consist of only aluminum. The aluminum could be substituted with MMC, Foam, Wood, Plastic, Titanium, Steel, or any other solid structure that will maintain a bat shape.

The composite could be either a polymer matrix composite or a metal matrix composite. The fibers used in the polymer matrix composite could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° compared to the axis of the length of the bat and every angle between in both plus and minus direction. The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite sleeve such as hand lay up, Resin transfer molding (RTM), Vacuum Bagging, Autoclave, and Filament winding.

An example of such a bat 1100 is as follows. One would form a bat 1100 consisting of an aluminum frame 1102 and aluminum shell 1104. A carbon fiber sock would be adhered to the aluminum shell 1104. The bat 1100 would be put into a mold and epoxy would be injected into the mold using an RTM process. The composite shell 1106 of the carbon fiber sock and the epoxy would then be cured and undergo various finishing operations for cleanup and cosmetics.

This bat 1100 example takes advantage of the strength, stiffness, and light weight of carbon fiber. The bat 1100 will be lighter allowing thinner aluminum as compared to similar styles. The barrel 1108 will be stronger leading to a longer durability as compared to similar styles.

Figure 12:
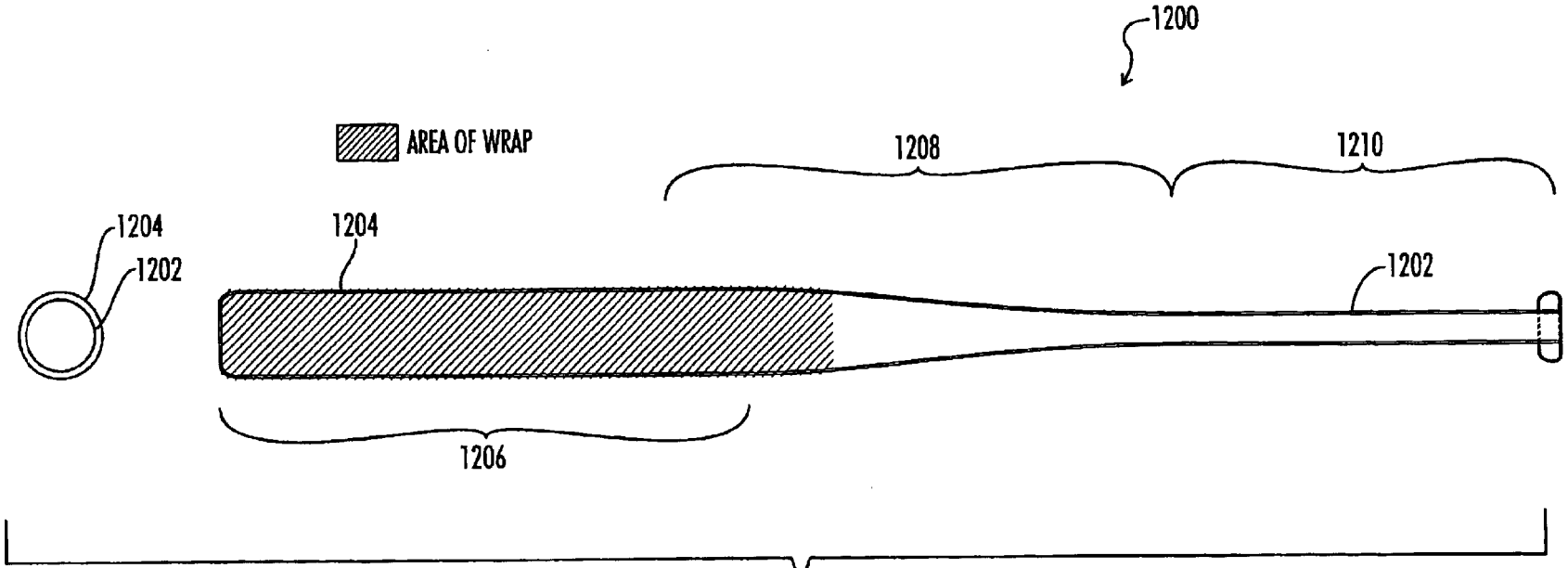

Embodiment 2 is shown in FIG. 12. This invention pertains to a bat 1200 with an aluminum frame 1202 and a composite shell 1204 outside of the aluminum frame 1202. The composite shell 1204 is in the barrel 1206 and slightly in the taper section 1208 of the bat 1200. The remaining taper section 1208 and handle section 1210 would consist of only aluminum. The aluminum could be substituted with MMC, Foam, Wood, Plastic, Titanium, Steel, or any other solid structure that will maintain a bat 1200 shape.

The composite could be either a polymer matrix composite or a metal matrix composite. The fibers used in the polymer matrix composite could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° and every angle between in both plus and minus direction. The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite sleeve such as hand lay up, Resin transfer molding (RTM), Vacuum Bagging, Autoclave, and Filament winding.

An example of such a bat 1200 is as follows. One would form a bat 1200 consisting of an aluminum frame 1202. A carbon fiber sock would be adhered to the aluminum frame 1202. Epoxy would then be applied to the fiber sock in a hand lay up process to make up the composite section 1204. Various rolling and processing steps would take place to minimize air bubbles in the composite shell 1204. The composite would then be cured and undergo various finishing operations for cleanup and cosmetics.

This bat 1200 example takes advantage of the strength, stiffness, and light weight of carbon fiber. The bat 1200 will be lighter allowing thinner aluminum as compared to similar styles. The barrel 1206 will be stronger leading to a longer durability as compared to similar styles.

Figure 13:
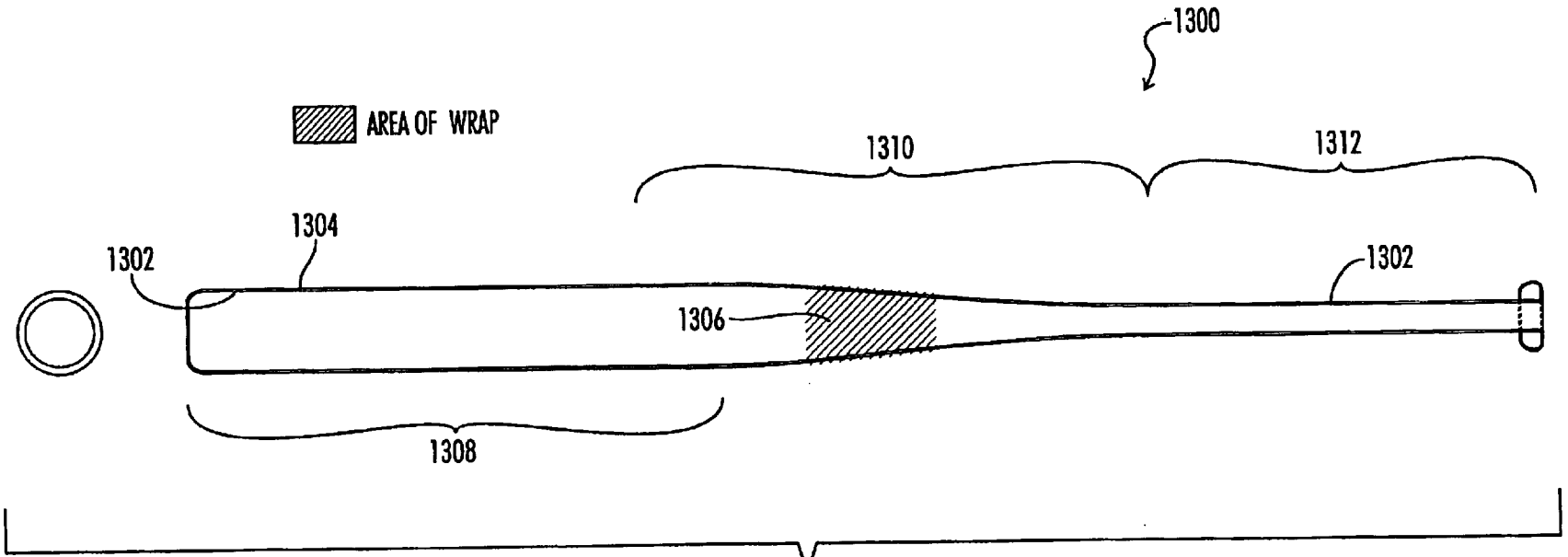

Embodiment 3 is shown in FIG. 13. This bat 1300 is constructed with an Aluminum frame 1302 and aluminum shell 1304 on the outside of the aluminum frame 1302 in the barrel 1308 and portion of the taper 1310 only. The composite 1306 would be applied only to the taper 1310 section of the bat 1300. The barrel 1308 and portion of the taper 1310 section along with the handle 1312 would remain exposed aluminum. The aluminum could be substituted with MMC, Foam, Wood, Plastic, Titanium, Steel, or any other solid structure that will maintain a bat 1300 shape.

The composite sleeve 1306 could be either a polymer matrix composite or a metal matrix composite. The fibers used in the polymer matrix composite could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° and every angle between in both plus and minus direction. The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite sleeve 1306 such as hand lay up, Resin transfer molding (RTM), Vacuum Bagging, Autoclave, and Filament winding.

An example of such a bat 1300 is as follows. One would form a bat 1300 consisting of an aluminum frame 1302. A carbon fiber sock would be adhered to the aluminum frame 1302 in the small portion of the taper 1310 section. Epoxy would then be applied to the fiber sock in a hand lay up process. Various rolling and processing steps would take place to minimize air bubbles in the composite 1306 shell. The composite 1306 would then be cured and undergo various finishing operations for cleanup and cosmetics.

This bat 1300 example takes advantage of the stiffness of carbon fiber. The added stiffness could be applied to a section of the bat 1300 that would alter the original kick point. Hitters at all levels of play require varying degrees of stiffness due to strength and swing speed. This would lead to a light weight option to add stiffness in a designated area.

Figure 14:
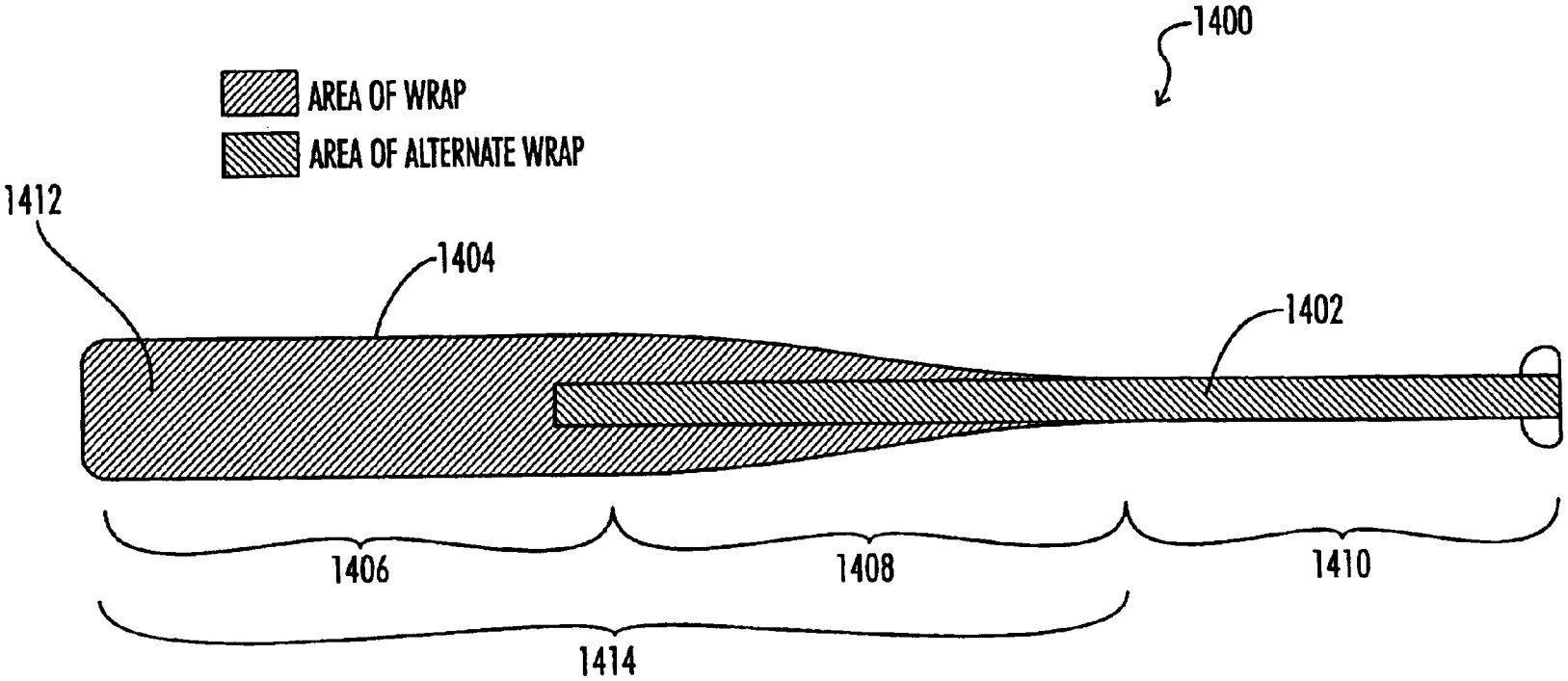

Embodiment 4 is shown in FIG. 14. This bat 1400 is constructed with an Aluminum frame 1402, and aluminum shell 1404 on the outside of the aluminum frame 1402 in the barrel 1406 and taper 1408. Composite 1412 would be applied to the barrel 1406, taper 1408 and handle 1410 section. The aluminum could be substituted with MMC, Foam, Wood, Plastic, Titanium, Steel, or any other solid structure that will maintain a bat 1400 shape.

The composite 1412 could be either a polymer matrix composite or a metal matrix composite. The fibers used in the polymer matrix composite could consist of aramid (such as Kevlar), carbon, glass, or metal fibers (Aluminum, Titanium or Boron). These fibers can consist of varying weights (having to do with thickness and weight) such as light, medium, or heavy. These fibers can either be dry fiber or pre-impregnated. The fibers could be in any orientation between 0° to 90° and every angle between in both plus and minus direction. The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite 1412 sleeve such as hand lay up, Resin transfer molding (RTM), Vacuum Bagging, Autoclave, and Filament winding.

An example of such a bat 1400 is as follows. One would make a core 1414 consisting of a foam barrel 1406 and taper 1408, and a wood frame 1402. A carbon sock would then be adhered to the entire foam and wood core. Epoxy would then be applied to the fiber sock in a hand lay up process. Various rolling and processing steps would take place to minimize air bubbles in the composite 1412 shell. The composite 1412 would then be cured and undergo various finishing operations for cleanup and cosmetics.

The lightweight properties of the foam, carbon and wood leads to a bat 1400 that is much lighter than any pertaining to the same market. The carbon composite 1412 aids in a strong enough bat 1400 to withstand the impacts created by an end user. The composite 1412 is also used to create a rigid skin that will keep its shape through normal usage. The foam and wood alone do not maintain the desired shape after usage.

Figure 15A:
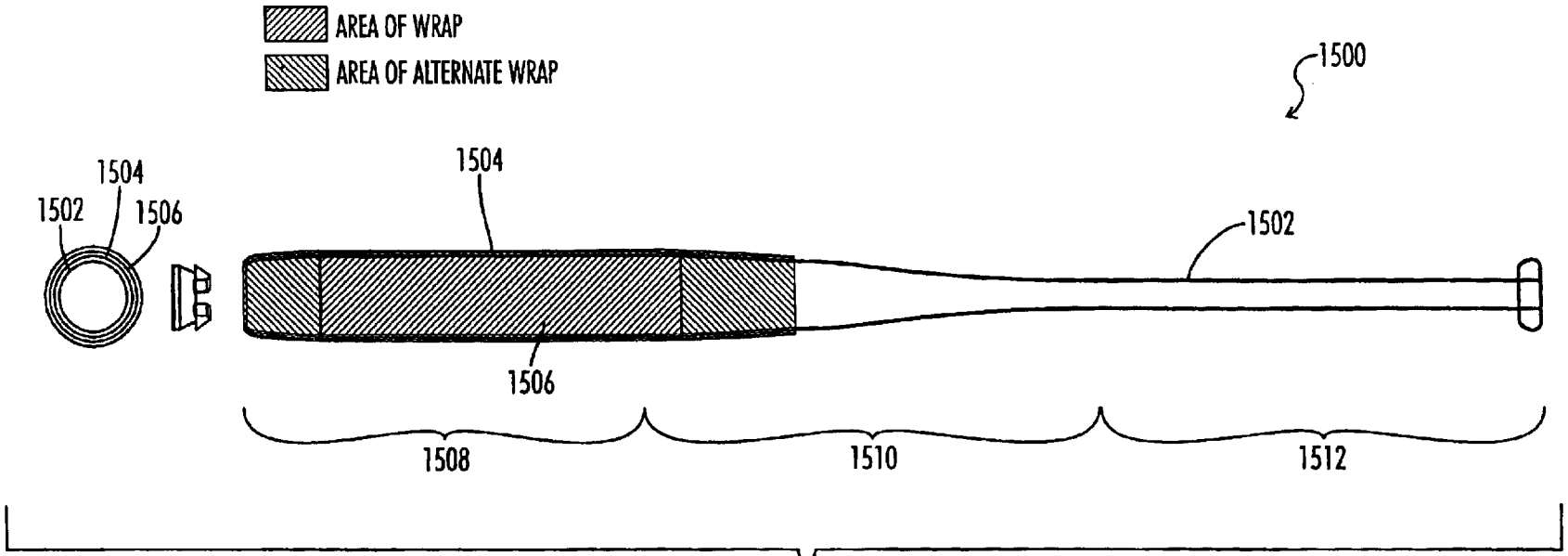
Figure 15B:
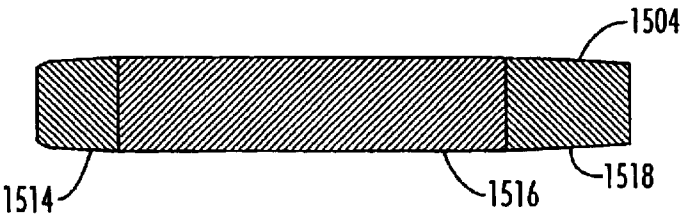

Embodiment 5 is shown in FIGS. 15*a* and 15*b*. This bat 1500 is constructed with an Aluminum frame 1502, and aluminum shell 1504 on the outside of the aluminum frame 1502 in the barrel 1508 and may cover a portion of the taper 1510 only without covering the handle 1512. Composite 1506 would be applied to the barrel 1508 section and portion of the taper 1510 only. The aluminum could be substituted with MMC, Foam, Wood, Plastic, Titanium, Steel, or any other solid structure that will maintain a bat 1500 shape. Shell 1504, that can also be an exposed barrel if shell is not used to cover barrel 1508 of frame 1502, preferably consists of three zones, taper region 1518, middle region 1516, and distal region 1514.

The composite 1506 could be either a polymer matrix composite 1506 or a metal matrix composite 1506. The fibers used in the polymer matrix composite 1506 could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° and every angle between in both plus and minus direction. The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite 1506 sleeve such as hand lay up, Resin transfer molding (RTM), Vacuum Bagging, Autoclave, and Filament winding.

An example of such a bat 1500 is as follows. One would form a bat 1500 consisting of an aluminum frame 1502 and aluminum shell 1504. A carbon and Kevlar fiber sock would be adhered to the aluminum shell 1504. The sock would be constructed in such a manner that both ends would be made of carbon and the middle of the sock would be made of a mixture of carbon and Kevlar. Thus carbon would be used in taper region 1518 and distal region 1514 while a carbon and Kevlar mix would be used in middle portion 1516. The bat 1500 would be put into a mold and epoxy would be injected into the mold using an RTM process. The composite 1506 would then be cured and undergo various finishing operations for cleanup and cosmetics.

The varying properties of the different fibers would give a hitting portion of the bat 1500 with varying stiffness. The stiffer carbon composite 1506 would be on both ends of the composite 1506 shell. A combination of Kevlar and carbon in the main hitting area would lead to a less stiff barrel 1508 giving more trampoline like effects. Kevlar is also known to transfer energy better than carbon.

Figure 16A:
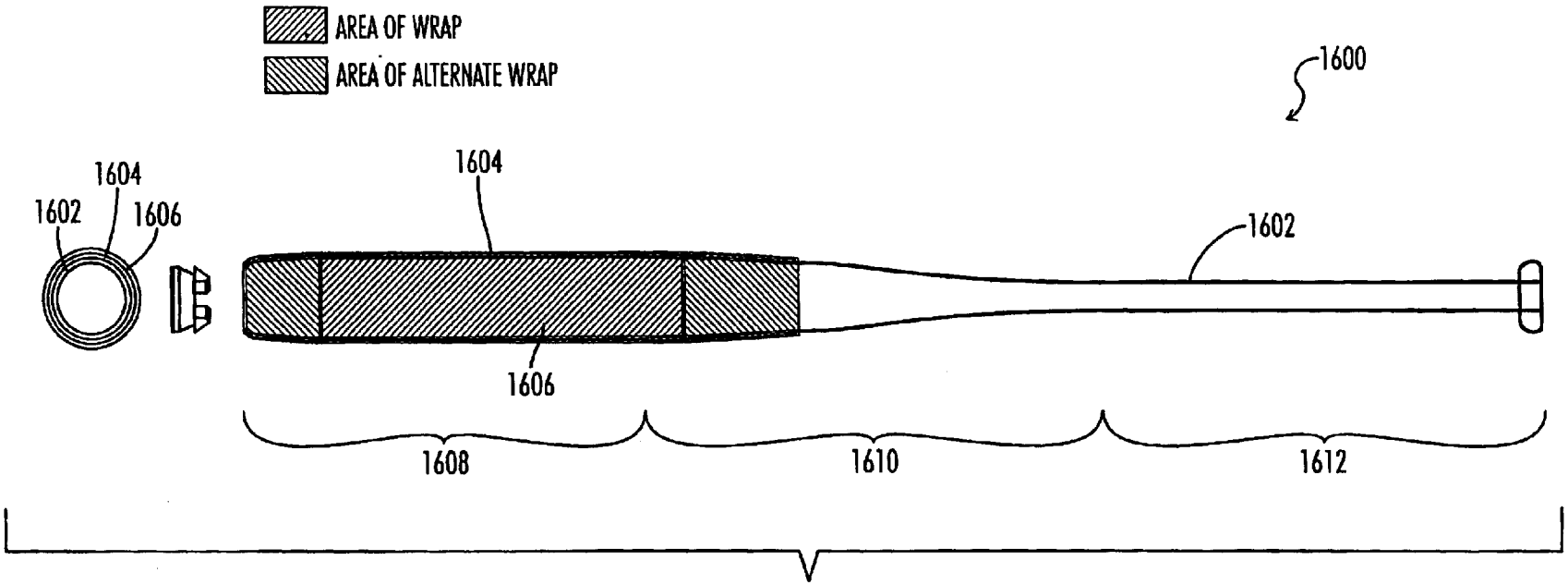
Figure 16B:
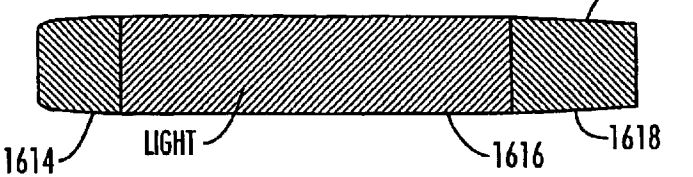

Embodiment 6 is shown in FIGS. 16*a* and 16*b*. This bat 1600 is constructed with an Aluminum frame 1602 and aluminum shell 1604 on the outside of the aluminum frame 1602 in the barrel 1608 and portion of the taper 1610 only. Composite 1606 would be applied to the barrel 1608 section and may be applied to a portion of the taper 1610 only. The handle 1606 is not covered. The aluminum could be substituted with MMC, Foam, Wood, Plastic, Titanium, Steel, or any other solid structure that will maintain a bat 1600 shape. The shell 1604 has taper region 1618, middle region 1616, and distal region 1614. Preferably, taper region 1618 and distal region 1614 is fiberglass while middle region 1616 is Kevlar. However, if no shell is used to cover barrel, composite may be placed over barrel of frame.

The composite 1606 could be either a polymer matrix composite or a metal matrix composite. The fibers used in the polymer matrix composite could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° and every angle between in both plus and minus direction The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite 1606 sleeve such as hand lay up, Resin transfer molding (RTM), Vacuum Bagging, Autoclave, and Filament winding.

An example of such a bat 1600 is as follows. One would form a bat 1600 consisting of an aluminum frame 1602 and aluminum shell 1604. A Kevlar and glass fiber sock would be adhered to the aluminum shell 1604. The sock would be constructed in such a manner that both ends would be made of heavy glass and the middle of the sock would be made of light Kevlar. The bat 1600 would be put into a mold and epoxy would be injected into the mold using an RTM process. The composite 1606 would then be cured and undergo various finishing operations for cleanup and cosmetics.

The varying weights of the different fibers would give a hitting portion of the bat 1600 with varying weight. Similar to perimeter weighting in golf club design, a hitting surface of a bat 1600 would be the end result. The heavier glass fiber composite 1606 would be on both ends of the composite 1606 shell. A lightweight Kevlar composite 1606 in the main hitting area would lead to lighter hitting area than the surrounding barrel 1608 portions giving a more forgiving (bigger sweet spot) hitting area. Preferably, taper region 1618 and distal region 1614 is fiberglass while middle region 1616 is Kevlar. However, if no shell is used to cover barrel, composite may be placed over barrel of frame.

Figure 17A:
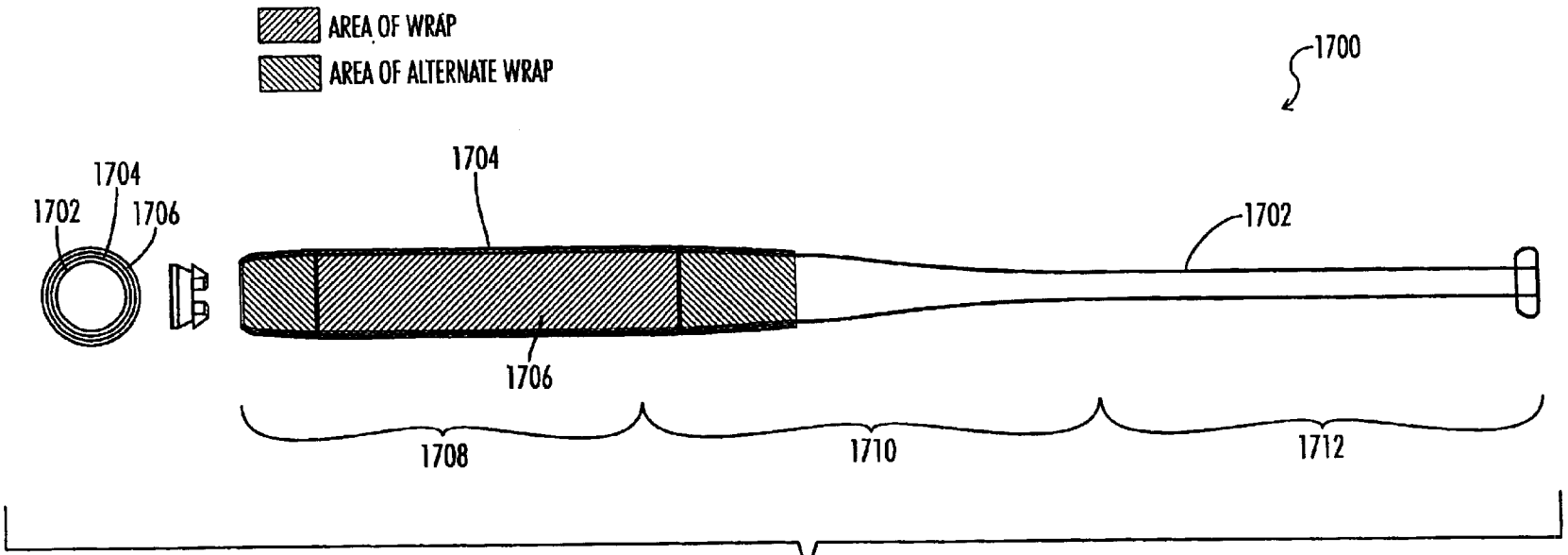
Figure 17B:
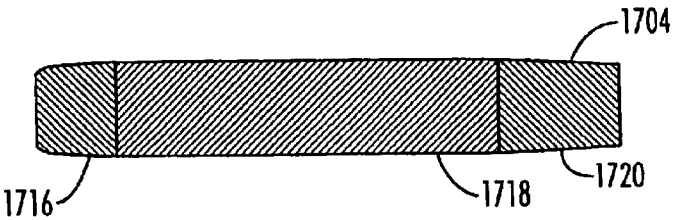

Embodiment 7 is shown in FIGS. 17*a* and 17*b*. This bat 1700 is constructed with an Aluminum frame 1702, or Aluminum frame 1702, and aluminum shell 1704 on the outside of the aluminum frame 1702 in the barrel 1708 and portion of the taper 1710 only without covering the handle 1712. Composite 1706 would be applied to the barrel 1708 section and portion of the taper 1710 only. The aluminum could be substituted with MMC, Foam, Wood, Plastic, Titanium, Steel, or any other solid structure that will maintain a bat 1700 shape. Shell 1704 has taper region 1720, middle region 1718, and distal region 1716.

The composite 1706 could be either a polymer matrix composite 1706 or a metal matrix composite 1706. The fibers used in the polymer matrix composite 1706 could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° and every angle between in both plus and minus direction. The fibers can be continuous or chopped.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite 1706 sleeve such as hand lay up, Resin transfer molding (RTM), Vacuum Bagging, Autoclave, and Filament winding.

An example of such a bat 1700 is as follows. One would form a bat 1700 consisting of an aluminum frame 1702 and aluminum shell 1704. A carbon sock would be adhered to the aluminum shell 1704. The sock would be constructed in such a manner that both ends would be made of heavy carbon and the middle of the sock would be made of light carbon. The bat 1700 would be put into a mold and epoxy would be injected into the mold using an RTM process. The composite 1706 would then be cured and undergo various finishing operations for cleanup and cosmetics.

The composite 1706 could be constructed in such a way that the sweet spot is thinner than the rest of the barrel 1708 giving more trampoline effect. Similar to perimeter weighting in golf club design, an enhanced hitting surface of a bat 1700 would be the end result. The heavier carbon composite 1706 would be on both ends 1716, 17120 of the composite 1706 shell 1704. A lightweight carbon composite 1706 in the main hitting area 1718 would lead to lighter hitting area 1718 than the surrounding barrel 1708 portions giving a more forgiving (bigger sweet spot) hitting area.

Figure 18:
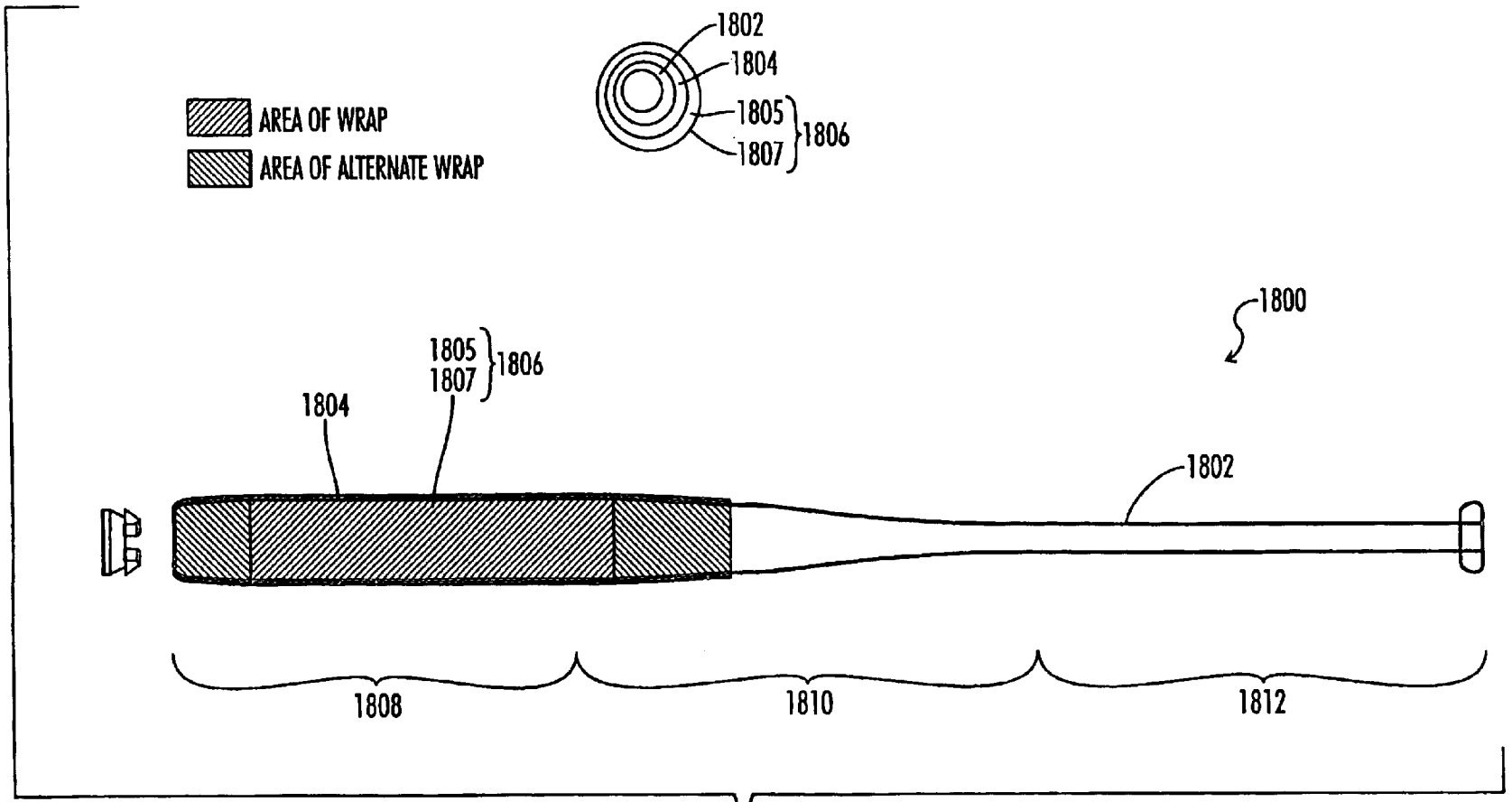

Embodiment 8 is shown in FIG. 18. This bat 1800 is constructed with an Aluminum frame 1802 and aluminum shell 1804 on the outside of the aluminum frame 1802 in the barrel 1808 and portion of the taper 1810 only without covering the handle 1812. Composite 1806 would be applied to the barrel 1808 section and possibly into a portion of the taper 1810 only without covering the handle 1812. The aluminum could be substituted with MMC, Foam, Wood, Plastic, Titanium, Steel, or any other solid structure that will maintain a bat 1800 shape.

The composite 1806 could be either a polymer matrix composite 1806 or a metal matrix composite 1806. The fibers used in the polymer matrix composite 1806 could consist of aramid (such as Kevlar), carbon, glass, or metal fibers (Aluminum, Titanium or Boron). These fibers can consist varying weights (having to do with thickness and weight) such as light, medium, or heavy. These fibers can either be dry fiber or pre-impregnated. The fibers could be in any orientation between 0° to 90° and every angle between in both plus and minus direction. The fibers can be continuous or chopped. Preferably, heavy carbon would be used to cover distal region 1716 and taper region 1729 while light carbon covers middle region 1718.

The polymers could be either thermosets or thermoplastics. Examples of Thermosets would be Epoxy, Polyester, and Polyurethane. Examples of thermoplastics would be ABS, Nylon, Polyether, and Polypropylene. Matrix materials for metal fibers could consist of certain polymers or metals such as Aluminum.

Many processes could be used for making the composite 1806 sleeve such as hand lay up, Resin transfer molding (RTM), Vacuum Bagging, Autoclave, and Filament winding.

An example of such a bat 1800 is as follows. One would form a bat 1800 consisting of an aluminum frame 1802 and aluminum shell 1804. On top of the aluminum may be a fiber combination 1805 that uses 50% Kevlar and 50% Carbon. Over the fiber combination 1805 would be a layer of 100% Fiberglass 1807. The Kevlar/Carbon Braid could be orientated +45°/−45°, while the fiberglass was 0°/90°. The bat 1800 would be put into a mold and epoxy would be injected into the mold using an RTM process. The composite 1806 would then be cured and undergo various finishing operations for cleanup and cosmetics.

This bat 1800 example takes advantage of the strength, stiffness, and light weight of carbon fiber. The bat 1800 will be lighter allowing thinner aluminum as compared to similar styles. The barrel 1808 will be stronger leading to a longer durability as compared to similar styles.

As noted in these examples several different types of materials and methods of construction may be used to form any of these bats or variations of them. The materials and methods used in these bats include the following materials and any of their equivalents and any of the equivalent methods for creating the frame, taper, and composites for these bats.

Materials

1. Carbon Fiber
   a. Light, Medium, and Heavy weights. (Has to do with the thickness of the fiber)
   b. Orientations −0° to 90° and every angle between in both plus and minus direction
   c. Fibers can be continuous or chopped
   d. Can be either dry fiber or prepreg
   e. Can be used with either thermoset or thermospolastic resin systems
2. Aramid Fiber
   a. Light, Medium, and Heavy weights. (Has to do with the thickness of the fiber)
   b. Orientations −0° to 90° and every angle between in both plus and minus direction compared to the length of the bat As for angles, we have found that +/−45 degrees works best for impact resistance. The fiber orientation we found to be best is actually a weave made up of half of the fibers going +45 degrees and the other half at −45 degrees. Just imaging looking at a checker board that is a diamond instead of a square.
   c. Fibers can be continuous or chopped
   d. Can be either dry fiber or prepreg
   e. Can be used with either thermoset or thermospolastic resin systems
   f. Example of Aramid fiber would be Kevlar
3. Glass Fiber
   a. Light, Medium, and Heavy weights. (Has to do with the thickness of the fiber)
   b. Orientations −0° to 90° and every angle between in both plus and minus direction
   c. Fibers can be continuous or chopped
   d. Can be either dry fiber or prepreg
   e. Can be used with either thermoset or thermospolastic resin systems
   f. Examples of Glass fibers would be E-glass and S-Glass
4. Metal Fiber
   a. Orientations −0° to 90° and every angle between in both plus and minus direction
   b. Fibers can be continuous or chopped
   c. Generally used as dry fiber and cast into shape with desired matrix
   d. Generally would he used in combination with a metal matrix system such as aluminum
   e. Examples of Metal fibers would be Aluminum or Titanium 5. Thermoset Resin System
   a. Material that holds the fibers together
   b. Once thermoset is cured, it is a permanent part. This resin can not be remolded or recycled
   c. Examples would be Epoxy, Polyester, and Polyurethane
6. Thermoplastic Resin System
   a. Material that holds the fibers together
   b. A thermoplastic is cured at room temperature. Once it is cured, it can be reheated and reused if desired.
   c. Examples would be ABS, Nylon, Polyether, and Polypropylene.

The following process or their equivalents may be used for these constructions.

1. Hand Lay Up
   a. Can be used with any of the fiber systems
   b. Can be used with any of the resin systems
   c. Can use either dry fiber or prepreg
   d. Description for Bat—Either a fiber sock or mat would be laid over the bat. Resin would then be brushed on and rolled for complete wet out of the fibers. Depending on the resin system either heat or ambient temperature would cure the part. Different degrees of finishing would be involved to make the part appealing.
2. RTM
   a. Can be used with any of the fiber systems
   b. Can be used with any of the resin systems
   c. Can use either dry fiber or prepreg
   d. Description for Bat—Either a fiber sock or mat would be laid over the bat. The bat and fibers would be inserted into a mold. Resin would then be pumped into the mold cavity for complete wet out of the fibers. Depending on the resin system either heat or ambient temperature would cure the part. Different degrees of finishing would be involved to make the part appealing.
3. Vacuum Bag
   a. Can be used with any of the fiber systems
   b. Can be used with any of the resin systems
   c. Can use either dry fiber or prepreg
   d. Description for Bat—Either a fiber sock or mat would be laid over the bat. Resin would then be brushed on and rolled for complete wet out of the fibers. A bag would then be put over the wet part and hooked up to a vacuum. This will force most of the air out of the finished part. Depending on the resin system either heat or ambient temperature would cure the part. Different degrees of finishing would be involved to make the part appealing.
4. Autoclave
   a. Can be used with any of the fiber systems
   b. Can be used with any of the resin systems
   c. Can use either dry fiber or prepreg
   d. Description for Bat—Either a fiber sock or mat would be laid over the bat. Resin would then be brushed on and rolled for complete wet out of the fibers. A bag would then be put over the wet part and hooked up to the autoclave system. This will create a pressure greater than that of a vacuum. This will force most of the air out of the finished part. Depending on the resin system either heat or ambient temperature would cure the part. Different degrees of finishing would be involved to make the part appealing.
5. Filament Winding
   a. Can be used with any of the fiber systems
   b. Can be used with any of the resin systems
   c. Description for Bat—A large winder would be set up for the desired fiber type and orientation. The bat would be used as a mandrel as the winder would spin creating a sock over the desired portion of the bat. From here either a hand layup, RTM, vacuum bag or autoclave could be used for the final processing. This method is an alternative to purchasing a fiber sock and putting it over the bat by hand.

Several different types of apparatus have be described as being a formed bat including.

1. Frame/aluminum Shell/composite Shell
   a. This concept is constructed with an Aluminum frame, an aluminum shell, and a composite shell on the outside of the aluminum shell in the barrel and portion of the taper only.
   b. The aluminum could be substituted with aluminum MMC, Foam, Wood, Plastic, Titanium, Steel, or any other solid structure that will maintain a bat shape.
   c. This bat would use the composite to add strength to the barrel section using a less dense structure leading to a lighter bat shell allowing for various design changes.
2. Frame/composite Shell
   a. This concept is constructed with an Aluminum frame, and a composite shell on the outside of the aluminum shell in the barrel and portion of the taper only.
   b. The aluminum could be substituted with aluminum MMC, Foam, Wood, Plastic, Titanium, Steel, or any other solid structure that will maintain a bat shape.
   c. This bat would use the composite to add strength to the barrel section using a less dense structure leading to a lighter bat shell allowing for various design changes.
3. Frame/composite Taper
   a. This concept is constructed with an Aluminum frame and aluminum shell on the outside of the aluminum frame in the barrel and portion of the taper only.
   b. The aluminum could be substituted with aluminum MMC, Foam, Wood, Plastic, Titanium, Steel, or any other solid structure that will maintain a bat shape.
   c. This bat would consist of an aluminum barrel, taper, and handle. Composite would be applied to the taper section only or the taper and handle section. The composite reinforcement would be used to alter the stiffness of the bat in that area.
4. Frame/full Composite Coverage Bat
   a. This concept is constructed with an Aluminum frame, or Aluminum frame, and aluminum shell on the outside of the aluminum frame in the barrel and portion of the taper only.
   b. The aluminum could be substituted with aluminum MMC, Foam, Wood, Plastic, Titanium, Steel, or any other solid structure that will maintain a bat shape.
   c. This bat would consist of an aluminum barrel, taper, and handle. Composite would be applied to the barrel, taper and handle section. The composite reinforcement would be used to give different sweet spot, stiffness, barrel strength, and decoration in any combination desired.
5. Composite Barrel
   a. This concept is constructed with an Aluminum frame and composite shell on the outside of the aluminum frame in the barrel and possibly a portion of the taper only.
   b. The aluminum could be substituted with aluminum MMC, Foam, Wood, Plastic, Titanium, Steel, or any other solid structure that will maintain a bat shape.
   c. The composite would be used to change the hitting performance by optimizing the sweet spot of the hitting area.

The fiber system would be vary throughout the length of the barrel. For example, carbon fiber could be used at the end of the barrel and end of taper. Kevlar could be used on the inner barrel where the sweet spot is located. This could give different hit performances and varying degrees of vibration.

6. Variable Weighting a. This concept is constructed with an Aluminum frame and composite shell on the outside of the aluminum frame in the barrel and portion of the taper only.

b. The aluminum could be substituted with aluminum MMC, Foam, Wood, Plastic, Titanium, Steel, or any other solid structure that will maintain a bat shape.

c. Similar to perimeter weighting in golf clubs, the composite could be made up in such a way that the barrel portion his heavier on either side of the sweet spot, thus increasing the size of the sweet spot.

7. Variable Wall Thickness a. This concept is constructed with an Aluminum frame and composite shell on the outside of the aluminum frame in the barrel and portion of the taper only.

b. The aluminum could be substituted with aluminum MMC, Foam, Wood, Plastic, Titanium, Steel, or any other solid structure that will maintain a bat shape.

c. The composite could be constructed in such a way that the sweet spot is thinner than the rest of the barrel giving more trampoline effect.

8. Variable Fiber Combinations a. Any of 1 through 7 could be accomplished by using a single type of fiber and resin or in combinations. For instance, on top of the aluminum may be a fiber combination that uses 50% Kevlar and 50% Carbon. Over this would be a layer of 100% Fiberglass. The Kevlar/Carbon Braid could be orientated +45°/−45°, while the fiberglass was 0°/90°.

Further advantages may be had through the combination or removal of an additional shell, such as the aluminum shells currently being used, with the different composite constructions of the present invention.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A bat, comprising:

a metal frame including a handle portion, a transition portion and a barrel portion, the barrel portion having a taper region, a middle region and a distal region; and a fiber reinforced composite outer shell covering only the barrel portion having a first composite material and a second composite material whereby the first composite material covers the barrel proximal the middle region and the second composite material covers the barrel portion proximal the taper region and proximal the distal region.

2. The bat of claim 1 wherein:

the first composite is a light composite; and the second composite is a heavy composite.

3. The bat of claim 1 wherein:

the first composite is a light carbon; and the second composite is a heavy carbon.

4. The bat of claim 1 wherein:

the first composite is Kevlar; and the second composite is fiberglass.

5. The bat of claim 1 wherein:

the first composite is a carbon and Kevlar mixture; and the second composite is a carbon.

6. A bat, comprising:

a metal frame including a handle portion, a transition portion and a barrel portion;

a shell attached to the frame proximal the barrel portion, the shell having a taper region, a middle region and a distal region; and a fiber reinforced composite outer shell covering only the shell having a first composite material and a second composite material whereby the first composite material covers the shell proximal the middle region and the second composite material covers the shell portion proximal the taper region and proximal the distal region.

7. The bat of claim 6 wherein:

the first composite is a light composite; and the second composite is a heavy composite.

8. The bat of claim 6 wherein:

the first composite is a light carbon; and the second composite is a heavy carbon.

9. The bat of claim 6 wherein:

the first composite is Kevlar; and the second composite is fiberglass.

10. The bat of claim 6 wherein:

the first composite is a carbon and Kevlar mixture; and the second composite is a carbon.

* * * * *